United States Patent [19]

Kemp

[11] 4,176,797

[45] Dec. 4, 1979

[54] FLUID MIXER AND COMMINUTER

[76] Inventor: Gibson D. Kemp, 3202 26th St., Lubbock, Tex. 79410

[21] Appl. No.: 913,573

[22] Filed: Jun. 8, 1978

[51] Int. Cl.[2] ..... B02C 7/02

[52] U.S. Cl. ..... 241/30; 241/46 B; 241/46.06; 241/253; 241/258; 366/605

[58] Field of Search ..... 416/185; 366/605, 263, 366/265, 343; 241/30, 46 B, 46.04, 251, 253, 46.06, 46.11, 46.13, 46.17, 172, 46.15, 257 R, 258

[56] References Cited

U.S. PATENT DOCUMENTS

| | | | |
|---|---|---|---|
| 2,464,588 | 3/1949 | Knudsen et al. | 241/258 X |
| 2,581,414 | 1/1952 | Hochberg | 241/46.17 X |
| 3,222,038 | 12/1965 | Ashcraft | 241/253 X |

FOREIGN PATENT DOCUMENTS

| | | | |
|---|---|---|---|
| 1336193 | 11/1973 | United Kingdom | 241/172 |

*Primary Examiner*—Mark Rosenbaum
*Attorney, Agent, or Firm*—Wendell Coffee

[57] ABSTRACT

Fluid mixtures, especially shelf-settled-out paints, are stirred and comminuted by rapidly rotating discs, one of which is fixed to a rotating rod while the other disc is allowed to float.

11 Claims, 4 Drawing Figures

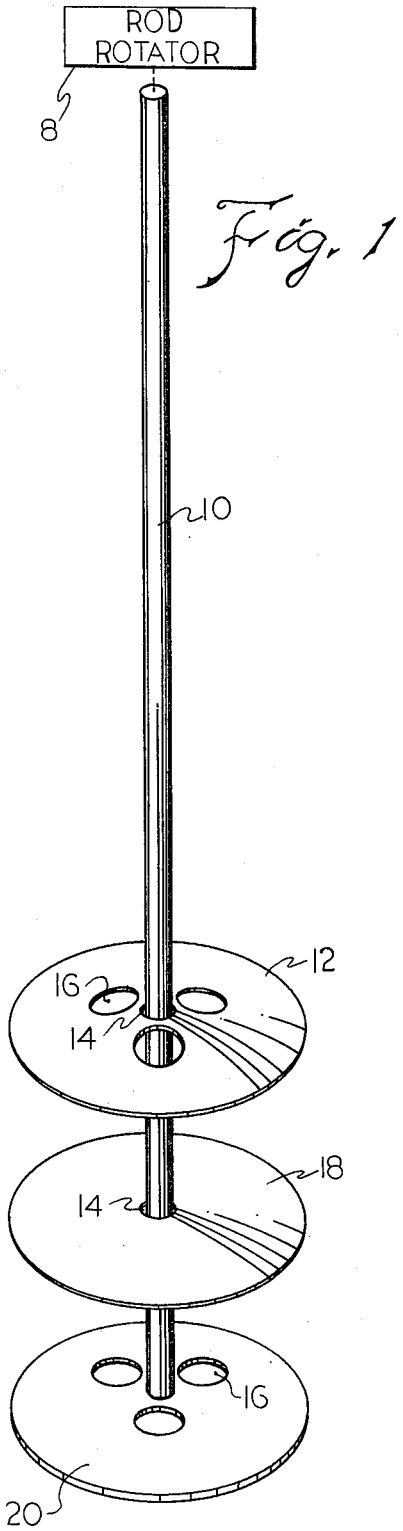
Fig. 1
Fig. 2
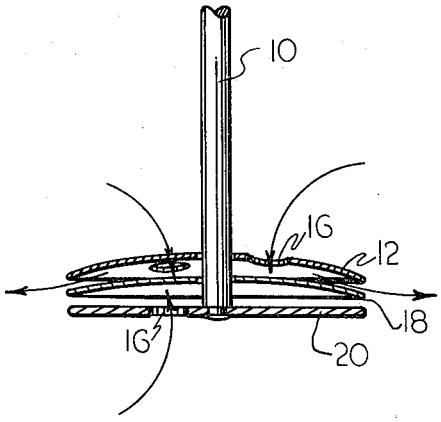
Fig. 3
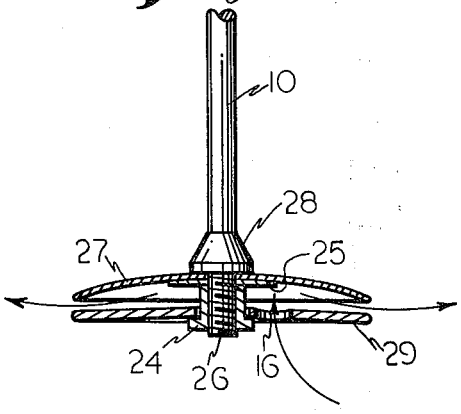
Fig. 4
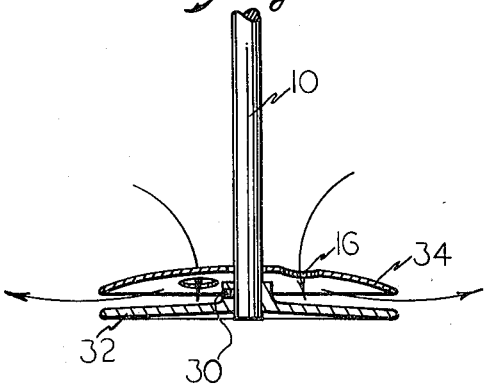

FLUID MIXER AND COMMINUTER

BACKGROUND OF THE INVENTION (1) Field of the Invention

This invention relates to the mixing and comminuting of fluids by rapidly rotaing discs. More specifically, it pertains to the returning of paint to a useable consistency by comminuting lumped and settled pigments and resins.

(2) Description of the Prior Art

Mixing the components of paint is an old problem. Before my invention there were many devices on the market for stirring paint. Perhaps the oldest and best known method was for the painter to take a wooden paddle in hand and stir the paint in the bucket.

Other devices included vibrators or shakers in which the whole can of paint was mechanically shaken and vibrated.

In addition to this, there are many patents on rotating stirrers. A rod is attached to a drill or other means for rotating and a disk upon the rod is immersed in the paint to stir the paint.

Also, in modern house construction using dry wallboard, a very thick plaster material (called "mud" in the trade) is used to fill the cracks between boards and to smooth the wall before applying a coating to it. In the prior art, the mixing of this mud has constituted particular problems.

In addition to this, the grinding of pulverant material, such as dry pigments to be used in paints, is a difficult chore. This may be done with a mortar and pestle or with a ball mill. Pulverant materials which flow are considered fluid materials in this application.

To the best of my knowledge, none of the devices for stirring the paint after it had been prepared and stored included comminuting.

Before filing this application a search of the prior art was made in the United States Patent and Trademark Office which revealed the following U.S. Pat. Nos.

Leighty: 2,231,926
Messbauer: 2,673,077
Gunas: 2,879,044
Place: 2,896,925
Patten: 3,069,144
Ziegler: 3,411,756
Hunnicut: 3,580,550

These patents show separated discs rigidly attached to rotary rods.

SUMMARY OF THE INVENTION:

(1) New and Different Function

I have invented a better way of mixing paints. I have discovered that if two discs are attached to a rod which may be chucked in a drill for rotation, that a superior result is obtained. Specifically, one of the discs is fixed to the rod and another disc floats on the rod. At least one of the discs is perforated.

Analysis of my invention will show that fluid is brought through the perforations of the discs near the axis and slung outward. The viscosity of the fluid together with its surface tension will cause the disc which is not securely attached to the rod to also rotate. The viscosity of the fluid will act as a drag upon the non-fixed disc and, therefore, it will not rotate as fast as the fixed disc. Thus, there will be a grinding or comminuting action between the two discs which are not rotating at the same speed.

The flow of the fluid between the two discs will produce a Bernoulli's effect which will pull the two discs together.

My invention accomplishes three important functions which make shelf-settled-out paint once again useable. These three functions are: (1) thoroughly mixing the fluid; (2) raising sediment from the bottom of the container; and (3) comminuting the sediment into suspendable particles; thus, improving the consistency of the liquid.

The orientation of slightly curved discs may be altered to more efficiently accomplish the specific job required. The normal configuration of the discs of my tool is a concave-convex arrangement. This orientation accomplishes the greatest mixing and comminuting functions. If both discs are oriented with the concave faces down, sediment from the bottom of the container is more efficiently raised. If the fluid has many large lumps in it, the convex-concave configuration may function the best.

Multiple discs may be used to accomplish a special result. E.g., discs with holes oriented above and below a solid disc "pump" from the top and bottom of the fluid.

The special function of my invention is facilitated by a pumping action caused when the fluid is forced from between the discs by centrifugal force. As the liquid is forced from between the discs at a high rate of speed, an area of lower pressure is created between the discs so more liquid is "pumped" into the cavity. This action accomplishes the desired mixing of the fluid. The lower pressure between the discs causes them to be forced together, this coupled with the speed differential in the rotation of the discs effect a grinding action which comminutes any particulate matter passing between the discs.

My invention is adaptable to mixing fluids of varying consistencies. It may be used to mix paste-like material, pulverant material, paints or fountain drinks like malts or shakes. Where incorporation of air into the mixture is desirable, the top disc should have holes in it. However, with paint mixing, aeration is not wanted, and the top disc should be solid.

For convenience in packaging and marketing, my device may be disassembled such that the rod is not attached to or extending through the axial apperture of any of the discs. One way to effect disassembly is to equip the bottom, fixed disc with a collar and set screw.

Otherwise, the fixed disc may be attached, as by welding, to the rotating rod and the tool marketed in boxes or other appropriate manner.

Although the explanation of my invention may seem somewhat complex, the equipment used to practice the invention is exceedingly simple. Even so the total function far exceeds the sum of the functions of the individual elements of rods, collars, discs, etc.

(2) Objects of this Invention

An object of this invention is to mix and comminute fluid material.

Further objects are to achieve the above with a device that is sturdy, compact, durable, lightweight, simple, safe, efficient, versatile, ecologically compatible, energy conserving, and reliable, yet inexpensive and easy to manufacture and operate.

Other objects are to achieve the above with a method that is versatile, ecologically compatible, energy conserving, rapid, efficient, and inexpensive, and does not require skilled people to operate.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a perspective view of one embodiment of my invention with a rotater shown schematically thereon.

FIG. 2 is a sectional view of the embodiment shown in FIG. 1.

FIG. 3 is a sectional view of a second embodiment.

FIG. 4 is a sectional view of a third embodiment.

DESCRIPTION OF THE PREFERRED EMBODIMENTS

Referring to FIGS. 1 and 2, it may be seen that the tool is comprised of rotatable rods 10, fixed disc 20 and floating discs 12 and 18. The rod may be rotated by rod rotater 8. The discs are constructed of plate material of uniform thickness and have the same diameter. A face of the discs 12 and 18 is slightly concave. All the discs are coaxial.

Fixed disc 20 is rigidly attached to the rod 10 as by welding. The floating discs 12 and 18 have axial holes 14 of greater diameter than the diameter of the rod 10. At least one disc or a multiple of them have perforations 16 to allow the fluid to be drawn into the cavity between the discs. The perforations 16 are adjacent the rod or axis of the discs.

FIG. 3 shows a variation in the tool which allows its total disassembly for easier packaging. The rod 10 is shown with flange 28 and threaded end 26. Fastening nut 24 is tightened on the threaded end 26 thereby forcing washer 25 into position rigidly fixing disc 27 to the rod 10. The axial hole in disc 29 is larger in diameter than the diameter of the shank or bushing on the fastening nut allowing disc 29 to float.

FIG. 4 depicts yet another mode of disassembly where disc 32 has a collar with a set screw 30 which may be tightened thereby rigidly fixing the disc to rod 10. Disc 34 is perforated and floats. The concave bottom disc has a periphery which is lower than the rod 10, i.e., the plane of the periphery does not enter the rod. Thus, the periphery will contact the bottom of a pain bucket and the rod will not contact the bottom.

In each embodiment, the discs are coaxial and closer together at their periphery than near the axis. When the rod 10 is rotated rapidly, it causes fluid to be slung from between the fixed disc and floating discs. The slinging out of the fluid decreases the pressure between the discs so more liquid is drawn into the cavity between the discs through the perforations 16. The lower pressure between the plates also forces the discs closer together helping accomplish the comminuting function of the tool.

As an aid to correlating the terms of the claims to the exemplary drawing, the following catalog of elements is provided:

| | | | |
|---|---|---|---|
| 8 | rod rotater | 25 | washer |
| 10 | rod | 26 | threaded end |

-continued

| | | | |
|---|---|---|---|
| 12 | floating disc | 27 | fixed disc |
| 14 | axial hole | 28 | flange |
| 16 | perforation | 29 | floating disc |
| 18 | floating solid disc | 30 | set screw |
| 20 | fixed disc | 32 | fixed disc |
| 24 | fastening nut | 34 | float disc |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. The process of blending, mixing and comminuting fluid material using a. two discs each having an axis, b. said discs being coaxial, c. the periphery of said discs being closer together than the discs at their axis; comprising the method of:

d. forcing the fluid material between the discs near the axis, and e. forcing the material between the peripheries of the discs, while f. moving one disc relative to the other, g. spinning one of the discs at high speed thereby h. slinging fluid outward, the flow of fluid between the two discs j. decreasing the pressure between the discs, thus k. forcing the discs together.

2. The invention as defined in claim 1 wherein m. said fluid material is paint.

3. A stirrer for blending, mixing and comminuting fluid material comprising in combination:

a. an elongated rod having an axis, b. at least one fixed disc rigidly and securely affixed to the rod coaxially therewith, c. at least one floating disc having an axial aperture therein larger than the rod, d. said rod extending through the axial aperture, e. said floating disc unattached to any structure so that the disc is free to rotate and move axially upon the rod, f. at least one of said disc having perforations therethrough adjacent to the rod, g. said rod adapted to be rotated at high speeds so that the fluid enters through the holes near the rod and is forced outward from the area between the discs.

4. The invention as defined in claim 3 further comprising:

g. said discs all having the same diameter.

5. The invention as defined in claim 3 wherein g. the fixed disc is adjacent to the end of the rod and the perimeter of the disc defines a plane which is beyond the end of said rod.

6. The invention as defined in claim 3 further comprising:

g. said discs being constructed of plate material having substantially uniform thickness, and h. at least one of the discs being concave on one face, and j. said discs being arranged on said shaft so that there is a cavity adjacent to the rod.

7. The invention as defined in claim 3 further comprising:

g. one of said discs being unperforated.

8. The invention as defined in claim 3 further comprising:

h. at least one of the discs being concave on one face, and j. said discs being arranged on said shaft so that there is a cavity adjacent to the rod, that is k. there being more distance between the two discs near the shaft than at the periphery.

9. The invention as defined in claim 8 further comprising:

h. said discs all having the same diameter.

10. The invention as defined in claim 9 further comprising:

j. one of said discs being unperforated.

11. The invention as defined in claim 10 further comprising:

k. said discs being constructed of plate material having substantially uniform thickness, and m. at least one of the discs being concave on one face.

* * * * *